US006478544B2

(12) United States Patent
Brandl et al.

(10) Patent No.: US 6,478,544 B2
(45) Date of Patent: Nov. 12, 2002

(54) BLADE ARRANGEMENT WITH DAMPING ELEMENTS

(75) Inventors: Herbert Brandl; Rudolf Kellerer, both of Waldshut-Tiengen (DE); Brammajyosula Ravindra, Ennetbaden (CH)

(73) Assignee: ALSTOM (Switzerland) Ltd, Baden (CH)

( * ) Notice: Subject to any disclaimer, the term of this patent is extended or adjusted under 35 U.S.C. 154(b) by 0 days.

(21) Appl. No.: 09/832,846

(22) Filed: Apr. 12, 2001

(65) Prior Publication Data

US 2001/0038793 A1 Nov. 8, 2001

(30) Foreign Application Priority Data

May 8, 2000 (DE) ..... 100 22 244

(51) Int. Cl.[7] ..... F01D 5/26
(52) U.S. Cl. ..... 416/190; 416/193 A; 416/500
(58) Field of Search ..... 415/119; 416/190, 416/193 A, 500

(56) References Cited

U.S. PATENT DOCUMENTS

| | | | | |
|---|---|---|---|---|
| 2,942,843 A | * | 6/1960 | Sampson | 416/500 |
| 4,917,574 A | | 4/1990 | Dodd et al. | |
| 5,143,517 A | * | 9/1992 | Vermont | 416/190 |
| 5,156,528 A | | 10/1992 | Bobo | |
| 5,205,713 A | * | 4/1993 | Szpunar et al. | 416/193 A |
| 5,261,790 A | * | 11/1993 | Dietz et al. | 416/193 A |

FOREIGN PATENT DOCUMENTS

| | | | |
|---|---|---|---|
| DE | 69100981 T2 | | 1/1994 |
| EP | 0280246 | | 8/1988 |
| GB | 2 112 466 A | * | 7/1983 |

OTHER PUBLICATIONS

"High–Cycle Fatigue Design Evolution and Experience of Free–Standing Combustion Turbine Blades", Scalzo, Transactions of the ASME, vol. 114, Apr. 1992, pp. 284–292.

* cited by examiner

*Primary Examiner*—Edward K. Look
*Assistant Examiner*—Ninh Nguyen
(74) *Attorney, Agent, or Firm*—Burns, Doane, Swecker & Mathis, L.L.P.

(57) ABSTRACT

The present invention relates to a blade arrangement with damping elements and to a method of damping vibrations of a blade arrangement. The blade arrangement comprises a rotor and blades arranged on the circumference of the rotor. Damping elements (2, 3) are arranged between the blades and are in contact with the blades due to a centrifugal force, acting in the radial direction, during rotation of the rotor. In this case, at least two damping elements (2, 3) are arranged one behind the other in the circumferential direction of the rotor between adjacent blades, which damping elements (2, 3), during rotation of the rotor, come into contact with one another via a contact surface (6), and of which a first damping element (2) comes into contact with a first friction surface (4) of one of the blades and a second damping element (3) comes into contact with a second friction surface (5) of the other blade.

A multiplicity of different vibration states can be effectively damped with the blade arrangement.

17 Claims, 4 Drawing Sheets

BLADE ARRANGEMENT WITH DAMPING ELEMENTS

The present invention relates to a blade arrangement with damping elements. The damping elements serve to dampen vibrations of the blade arrangement. The blade arrangement comprises a rotor and blades arranged on the circumference of the rotor, damping elements being loosely arranged between the blades and being in contact with the blades due to a centrifugal force, acting in the radial direction, during rotation of the rotor about a rotor axis.

Such blade arrangements are used in particular in fluid-flow machines, such as gas turbines. In this case, the individual blades generally consist of the blade body, a blade platform and the blade root, which is attached in corresponding recesses on the circumference of the rotor. During operation of the blade arrangement, undesirable flexural and torsional vibrations are produced by various excitation causes and may lead to premature material fatigue and thus to a shortened service life of the blade arrangement. The present invention relates to a blade arrangement with damping elements for damping these undesirable vibrations.

To reduce the vibrations of blade arrangements, damping elements which act between the individual blades are already used. As a rule, these damping elements are loose bodies which, in the state of rest, first of all lie between the blade roots of the blades on the rotor or on corresponding supporting structures and, during operation of the rotor, are pressed against the underside of the blade platforms of adjacent blades on account of the centrifugal force acting in the radial direction. In this case, each damping element is in contact with both adjacent blade platforms at the same time. As a result, the kinetic energy of a relative movement, caused by vibrations, between the blades can be converted into friction energy between the respective blade platforms and the adjoining damping element. This dampens the vibrations and leads overall to a reduced vibration load on the blade arrangement.

U.S. Pat. No. 4,917,574, for example, discloses such a blade arrangement with damping elements. In this arrangement, the blade platforms of adjacent blades form recesses with their underside, into which recesses spherical bodies are pressed as damping elements by the centrifugal force during rotation.

A further possibility of configuring the damping elements is to design them as bar-shaped elements which have a round cross section and are arranged parallel to the rotor axis between adjacent blades. In this case, the arrangement may be made, for example, in a corresponding lateral recess of the blade root or the blade platform of one of the adjacent blades. Such an arrangement is dealt with, for example, in A. J. Scalzo, Journal of Engineering for Gas Turbines and Power, Vol. 114, April 1992, on pages 289 and 290. This form (used frequently) of the damping elements having a circular cross section additionally seals off the gas flow of a gas turbine from the rotor and is therefore also designated as "seal-pin damper". However, a disadvantage of these damping elements consists in the fact that the damping element can jam under certain conditions. Relative movements are thereby prevented, as a result of which large stresses are produced at the transition points from the damping element to the blades. These stresses lead to premature material fatigue and can promote the formation of cracks in the blades. Furthermore, these damping elements having a circular cross-sectional shape do not act in the same way in the case of all the vibrations of a blade arrangement which occur, so that certain vibration states may occur in a virtually undamped manner. In particular, in the case of these damping elements having a circular cross-sectional shape, it may happen that no relative movement occurs between the contact surfaces or the damping elements roll on the contact surface instead of performing a sliding movement.

A further blade arrangement with damping elements is described, for example, in U.S. Pat. No. 5,156,528. In this arrangement, marginal regions of adjacent blade platforms opposite one another form a recess or guide which narrows in the radial direction and into which the damping element is pressed by the centrifugal force. In this case, the damping element is designed with a wedge-shaped cross section, the wedge angle corresponding to the angle of the V-shaped recess formed by the two marginal regions of the blade platforms. With this wedge-shaped configuration of the damping elements, vibration modes of the blade arrangement which are different from those which are effectively influenced by the damping elements described above can in turn be efficiently damped. In particular, these wedge-shaped vibration elements are not suitable for the damping of equiphase vibration modes. Furthermore, there is the problem with these damping elements that they can tilt during use under certain conditions, as a result of which the damping effect is greatly reduced.

The object of the present invention consists in specifying a blade arrangement with damping elements and also a method of damping vibrations of a blade arrangement, with which blade arrangement and method good damping of a multiplicity of different vibration states can be achieved.

The blade arrangement with damping elements comprises a rotor and blades arranged on the circumference of the rotor. Damping elements are arranged between the blades and are brought into contact with the blades due to the centrifugal force, acting in the radial direction, during rotation of the rotor about the rotor axis. The blade arrangement is characterized in that a plurality of damping elements are arranged one behind the other in the circumferential direction of the rotor at least between two adjacent blades. These damping elements are configured and arranged in such a way that, during rotation of the rotor, the damping elements arranged one behind the other come into contact with one another via one or more contact surfaces, and a first damping element of the damping elements arranged one behind the other comes into contact with a first friction surface of one of the adjacent blades and a second damping element of the damping elements arranged one behind the other comes into contact with a second friction surface of the other adjacent blade.

In the present arrangement, in contrast to the known arrangements of the prior art, one or more further surfaces, the contact surfaces between the two or more damping elements, are thus available for the conversion of kinetic vibration energy into friction energy. Furthermore, due to this/these additional contact surface/surfaces, the risk of seizing of the damping elements, as can occur under certain vibration conditions in the case of the damping elements of the prior art having a circular cross-sectional shape, is reduced. The present arrangement offers in particular the possibility of designing the two or more damping elements in forms differing from one another in order to be able to optimally adapt them to the respective damping requirements. In this case, there are no limits to the diversity of forms, as long as the mutual friction contacts and the friction contacts with the blades or blade platforms can be maintained during operation.

The mass center of the group of damping elements arranged one behind the other may be selected in such a way that it does not lie symmetrically between the two adjacent blades or friction surfaces in the circumferential direction of the rotor. As a result, the load can be distributed nonuniformly over the damping elements—in particular when using two damping elements arranged one behind the other. The asymmetry may be specifically set by a different geometrical configuration or by different masses of the two damping elements. Due to the multiplicity of possible combinations, the groups of damping elements can be optimally configured for each application. In particular, the suitable selection of the friction or contact surfaces, the mass and the position of the mass center can ensure that the damping elements do not seize.

In this case, the damping elements should also have a high stiffness/weight ratio. This may also be achieved by a hollow form of these elements.

The damping elements of a group may be made of different materials. Thus, for example, cobalt may be selected as the basic material of one of two damping elements, and nickel may be selected as the basic material of the other damping element. This permits different coefficients of friction at the respective friction surfaces with the blades, so that, due to the material selection, further adaptability is available for achieving optimal vibration damping.

The damping elements in this case, just as in the known arrangements of the prior art, are pressed against the underside of the blade platforms by the centrifugal force during the rotation of the rotor. For this purpose, the blade platforms should be suitably shaped or should form grooves at their undersides in adaptation to the form of the damping elements. However, it goes without saying that, in addition to the blade platforms, other regions of the blade root may also be designed for accommodating the damping elements by suitable shaping. In the state of rest of the rotor, the damping elements can also be held by suitable retaining systems.

In a preferred embodiment of the present blade arrangement, a combination of a bar-shaped damping element having a circular cross section and a wedge-shaped damping element, i.e. a bar-shaped element having a wedge-shaped cross section, is used. A multiplicity of different vibration states can be effectively damped by this combination of damping elements having a different effect. Whereas primarily equiphase vibrations are effectively damped with the bar-shaped damping element having a circular cross section, the wedge-shaped damping element acts primarily on vibrations which do not occur in equiphase.

Furthermore, due to the contact surface additionally produced between the damping elements for absorbing vibration energy, the problem of seizing which occurs when using only a bar-shaped damping element having a circular cross section can be avoided. This prolongs the service life of the blade arrangement.

More than two damping elements may of course also be arranged one behind the other. Thus, for example, three damping elements may be used, of which one has a circular cross section and the other two have a wedge-shaped cross section—or vice versa.

The group according to the invention of damping elements arranged one behind the other can be used only between individual blades or also between all the adjacent blades of the blading. Recently, it has also been found that fluttering can be reduced or avoided by mistuning of the dampers. In this case, the possibility of an asymmetrical damper configuration of the present invention offers distinct advantages. Thus, for example, the damping elements, arranged one behind the other, of a group may be made of different materials and/or may have different geometrical forms, this pattern of materials or forms repeating itself in a transposed manner over the entire blading. Likewise, for example, the relative position of a damping element having a wedge-shaped cross section to a damping element having a circular cross section can be transposed from blade to blade in order to achieve the desired mistuning.

Furthermore, two or more groups of the damping elements arranged one behind the other can be arranged between respectively adjacent blades in an identical or different configuration over the axial extent of the blades. As a result, it is possible to effectively dampen the most diverse vibration forms. The damper configurations of the individual groups are in each case optimized in form and/or mass ratio and/or geometrical dimensions in accordance with the vibration form to be damped.

The blade arrangement according to the invention will again be explained by way of example below with reference to exemplary embodiments in combination with the drawings without restricting the general inventive idea. In the drawing.

Figure 1:
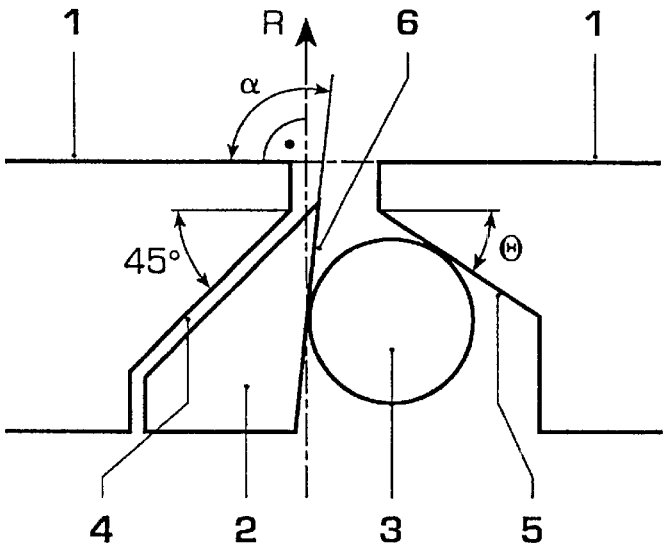
FIG. 1 shows a first example for a configuration and arrangement of the damping elements in the blade arrangement according to the invention.

FIG. 1 shows a first exemplary embodiment for a configuration of the damping elements in the blade arrangement according to the invention. The figure shows a detail of the blade arrangement in a sectional plane perpendicular to the rotor axis. In this case, the blade platforms 1 of adjacent blades can be seen, which are attached (not shown) to the rotor blade and are at a small distance from one another. The undersides of the two blade platforms 1 form friction surfaces 4, 5, against which the two damping elements 2, 3 are pressed by the centrifugal force during rotation of the rotor. In this example, the friction surfaces 4, 5 are inclined at an angle of about 45° to the plane which is spread out by the radial direction and the rotor axis. In this example, a damping element 2 having a wedge-shaped cross section—designated below as wedge-shaped damping element—is used together with a damping element 3 having a circular cross section—designated below as circular damping element. Both damping elements are of bar-shaped design in the axial direction, as known from the prior art.

If the entire system vibrates, a relative movement takes place between the two adjacent blade platforms 1, which in turn leads to a relative movement between the wedge-shaped damping element 2 and the friction surface 4, between the circular damping element 3 and the friction surface 5, and to a relative movement between the two damping elements at the contact surface 6. Vibration energy can therefore be converted into friction energy at all three contact points, so that effective vibration damping is achieved.

Such a configuration and arrangement permit a movement of the damping elements relative to one another and to the blade platforms in the radial direction for the optimum damping of equiphase flexural vibrations. At the same time, the problem of seizing which occurs with damping elements having a circular cross section is avoided without having to maintain for this purpose a certain angle of inclination of the friction surface 5 on the blade platform.

Figure 2:
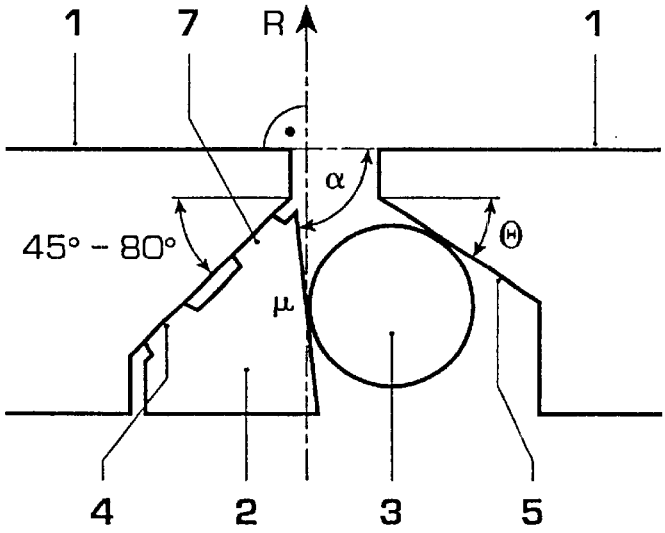
FIG. 2 shows a second example for a configuration and arrangement of the damping elements in the blade arrangement according to the invention.

FIG. 2 shows a further example for the configuration and arrangement of the damping elements in the present blade arrangement. In this embodiment, which otherwise corresponds to the embodiment in FIG. 1, that surface of the wedge-shaped damping element 2 which comes into contact with the friction surface 4 of the blade platform is provided with prominences or raised regions 7. These raised regions 7 serve to avoid tilting of the wedge-shaped damping element relative to the friction surface 4, as could occur under certain vibration conditions. Possible tilting of the damping element, which leads to impairment of the damping behavior, is therefore avoided by this configuration.

In this exemplary embodiment, and also in the further exemplary embodiments, the inclination of the friction surface 4 on the side of the wedge-shaped damping element 2 relative to a plane running perpendicularly to the radial direction may be between 45° and 80° and is selected in such a way that seizing of the damping element 2 is prevented. The angle $\alpha$ between the contact surface 6 of wedge-shaped damping element 2 and circular damping element 3 and the plane running perpendicularly to the radial direction may be selected as desired in order to obtain the requisite stability and to prevent the seizing of the damping element 3. This angle $\alpha$ may in particular also be selected to be markedly less than 90° The angle $\theta$ between the friction surface 5 and the plane running perpendicularly to the radial direction is obtained at $\alpha=90°$ from the condition $\mu \leqq \cos\theta/(1+\sin\theta)$ in order to avoid the seizing of the damping element 3, where $\mu$ is the coefficient of friction at the contact surface 6. Such a condition for $\alpha$ and $\theta$ can be derived at an angle $\alpha<90°$.

Figure 3:
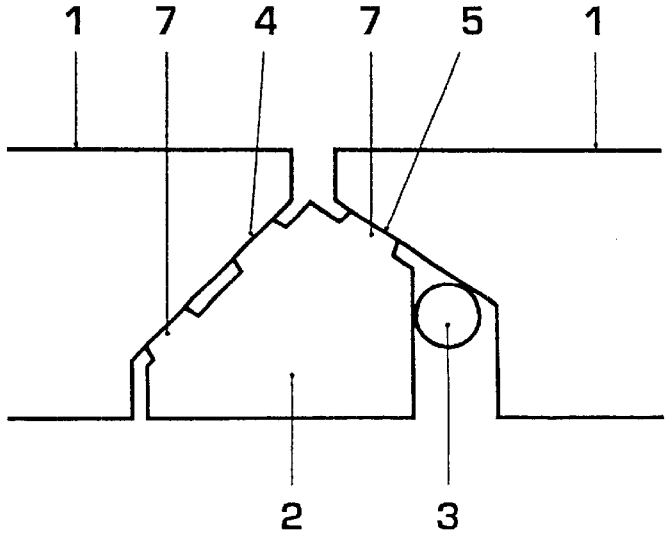
FIG. 3 shows a third example for a configuration and arrangement of the damping elements in the blade arrangement according to the invention.

A further example for a configuration of the damping elements of the present blade arrangement is shown in FIG. 3. In this arrangement, the first damping element 2—again in a wedge shape—is configured in such a way that it comes into contact with both friction surfaces 4, 5 of the two adjacent blade platforms 1 during rotation of the rotor. In this case, too, a further damping element having a circular cross section 3 is again used, which likewise comes into frictional contact with the friction surface 5 of one blade platform 1. In this case, the diameter of the circular damping element 3, under otherwise identical geometrical conditions, must of course be smaller than in the embodiments in FIGS. 1 and 2.

The wedge-shaped damping element 2 is again provided with raised regions 7 in order to avoid the tilt instability already explained.

In contrast to the embodiments in FIGS. 1 and 2, additional friction contact occurs between the first damping element 2 and the friction surface 5 in the embodiment in FIG. 3. An additional contact point is therefore available for absorbing vibration energy. In this example, too, the circular damping element 3 brings about efficient damping of radial relative movements, whereas the wedge-shaped damping element takes over the damping of the other vibration modes.

Figure 5:
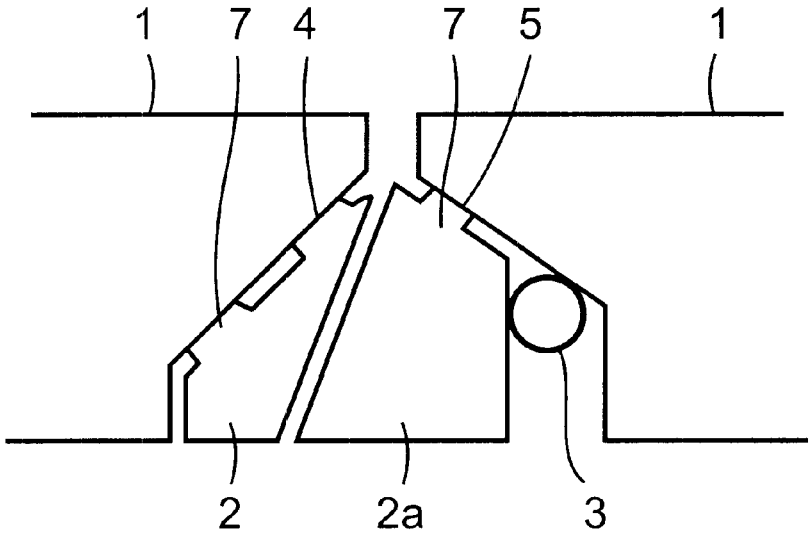
FIG. 5 shows a fourth example for a configuration and arrangement of the damping elements in the blade arrangement according to the invention.
Figure 6:
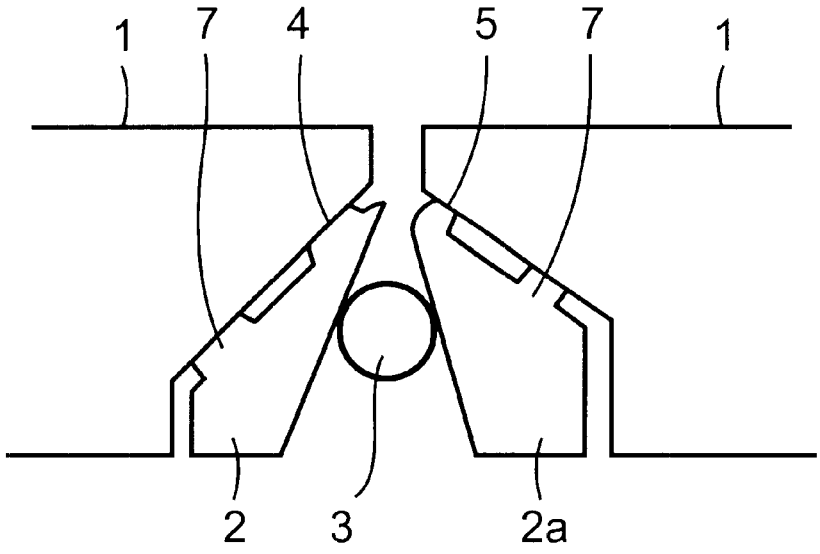
FIG. 6 shows a fifth example for a configuration and arrangement of the damping elements in the blade arrangement according to the invention.
Figure 7:
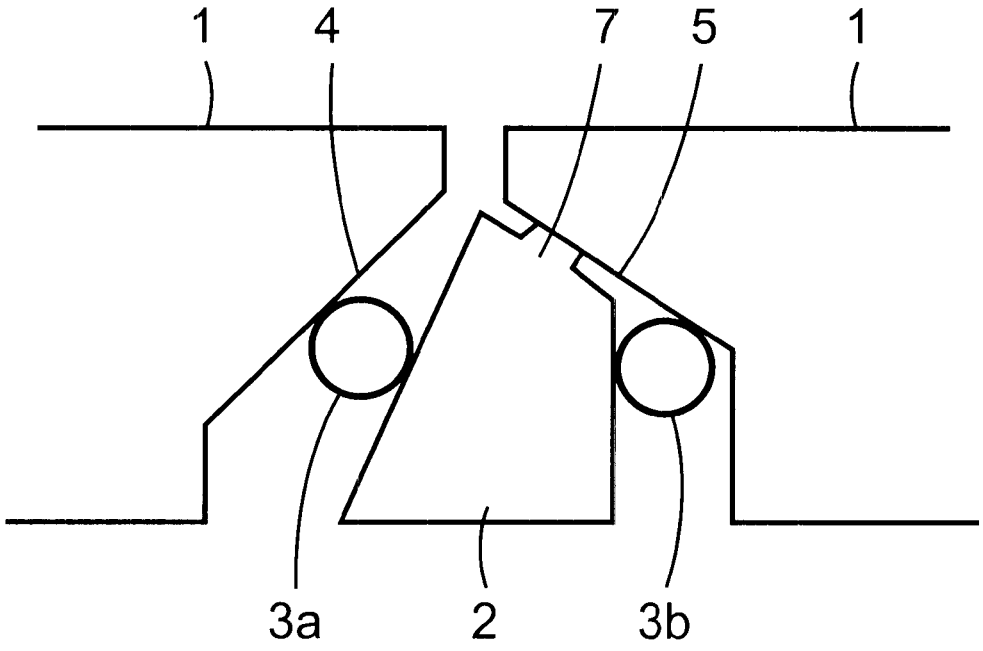
FIG. 7 shows a sixth example for a configuration and arrangement of the damping elements in the blade arrangement according to the invention.

FIGS. 5, 6, and 7 show further examples for configurations of the damping elements of the present blade arrangement. In FIG. 5, a third damping element 2*a* having a wedge-shaped cross section is arranged between a first damping element 2 having a wedge-shaped cross section and a second damping element 3 having a circular cross section. In FIG. 6, a third damping element 3 having a circular cross section is arranged between a first damping element 2 and a second damping element 2*a*, having wedge-shaped cross sections of different geometrical shapes. In FIG. 7, a third damping element 2 having a wedge-shaped cross section is arranged between a first damping element 3*a* and a second damping element 3*b*, both having circular cross sections, but if desired, having different diameters and/or different geometrical shapes.

Figure 4:
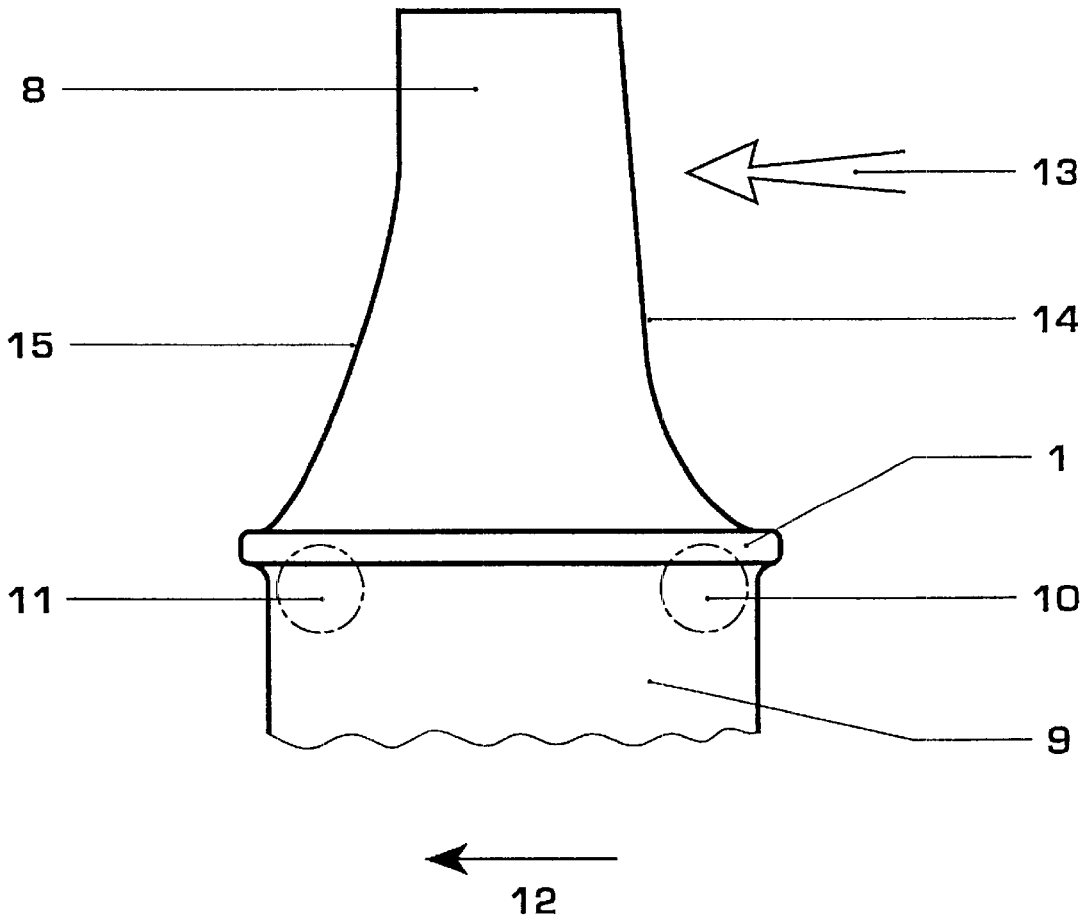
FIG. 4 shows an example for the arrangement of two groups of damping elements over the axial extent of the blades.

Finally, FIG. 4 schematically shows an example for the arrangement of two groups of damping elements over the axial extent of the blades. The blade body 8, the blade platform 1 and the blade root 9 can be seen in the figure. Indicated here over the axial extent of the blade (axial direction 12) are the positions of two groups 10, 11 of damping elements which are arranged one behind the other and are configured according to the patent claims, for example as in the preceding examples. In this example, the first group 10 is located at the leading edge 14 of the blade, and the second group 11 is located at the trailing edge 15. The direction of flow 13 is indicated by an arrow. Different vibration modes can be effectively damped by an asymmetrical arrangement or configuration of the groups in the axial direction.

The configurations of the present blade arrangement are suitable for damping a multiplicity of possible resonant and non-resonant vibration excitations, such as, for example, fluttering, shaking or stochastic excitation. The possibility of the two damping elements being configured so as to differ from one another geometrically permits optimum adaptation to the respective conditions. Even in the case of platforms inclined relative to the rotor axis, the damping elements can be used in an appropriately inclined position or orientation.

The damping elements are suitable both for use in low-pressure and high-pressure turbines and for compressor blades. They may be used as simple damping elements or for additional sealing as damping and sealing elements.

| List of designations |
|---|
| 1 Blade platform |
| 2 First damping element |
| 3 Second damping element |
| 4 First friction surface |
| 5 Second friction surface |
| 6 Contact surface |
| 7 Prominences |
| 8 Blade body |
| 9 Blade root |
| 10 First group |
| 11 Second group |
| 12 Axial direction |
| 13 Direction of flow |
| 14 Leading edge |
| 15 Trailing edge |

What is claimed is:

1. A blade arrangement, comprising:

a rotor;

blades arranged at the circumference of the rotor;

at least one set of damping elements arranged between at least two adjacent blades, said at least one set of damping elements comprising at least a first damping element and a second damping element arranged one behind the other in the circumferential direction of the rotor, wherein said first damping element and said second damping element of said at least one set of damping elements have different geometrical shapes, and the damping elements being arranged such that, during rotation of the rotor, due to a centrifugal force acting in the radial direction of the rotor, the damping elements arranged one behind the other in the circumferential direction of the rotor come into contact with one another at at least one contact surface, and the first damping element of said at least one set of damping elements comes into contact with a first friction surface of a first adjacent blade, and the second damping element of said at least one set of damping elements comes into contact with a second friction surface of a second adjacent blade.

2. The blade arrangement as claimed in claim 1, wherein the at least one set of damping elements arranged one behind the other comprise the first damping element, the second damping element and a third damping element arranged in the circumferential direction of the rotor between the first damping element and the second damping element.

3. The blade arrangement as claimed in claim 2, wherein the third damping element has a wedge-shaped cross section, and the first damping element and the second damping element have circular or elliptical cross sections.

4. The blade arrangement as claimed in claim 2, wherein the third damping element has a circular or elliptical cross section, and the first damping element and the second damping element have wedge-shaped cross sections.

5. The blade arrangement as claimed in claim 1, wherein a contact surface between the first damping element and the second damping element runs approximately parallel to the radial direction.

6. The blade arrangement as claimed in claim 1, wherein at least one damping element in a set of damping elements has a wedge-shaped cross section, and at least one damping element in said set of damping elements has one of a circular cross section and an elliptical cross section.

7. The blade arrangement as claimed in claim 6, wherein the wedge angle of the wedge-shaped cross section of the first damping element corresponds to the angle between the first friction surface and the plane spread out by the radial direction and the rotor axis.

8. The blade arrangement as claimed in claim 6, wherein surfaces of the first damping element which come into contact with the friction surface or friction surfaces have elevations.

9. The blade arrangement as claimed in claim 1, wherein the first damping element is configured and arranged in such a way that it also comes into contact with the second friction surface during rotation of the rotor.

10. The blade arrangement as claimed in claim 9, with the first damping element having a wedge-shaped cross section, and the wedge angle of the wedge-shaped cross section corresponding to the angle between the first friction surface and the second friction surface.

11. The blade arrangement as claimed in claim 1, wherein the first friction surface and the second friction surface are in each case formed by a bottom side of a blade platform of the respective blade, the friction surfaces being inclined relative to the plane spread out by the radial direction and the rotor axis in such a way that they jointly form a V-shaped guide into which the damping elements are pressed by centrifugal force.

12. The blade arrangement as claimed in claim 1, wherein the common center of gravity of a set of damping elements is arranged off-center between the two adjacent blades or friction surfaces in the circumferential direction of the rotor.

13. The blade arrangement as claimed in claim 1, wherein at least one set of damping elements are arranged between further adjacent blades.

14. The blade arrangement as claimed in claim 13, wherein at least two sets of damping elements arranged between different adjacent blades differ in their configuration.

15. A method of damping vibrations of a blade arrangement, said blade arrangement comprising:

a rotor, and blades arranged at the circumference of the rotor, and at least one set of damping elements arranged between at least two adjacent blades, said at least one set of damping elements comprising at least a first damping element and a second damping element arranged one behind the other in the circumferential direction of the rotor, wherein said first damping element and said second damping element of said at least one set of damping elements have different geometrical shapes; said method comprising the steps of rotating the rotor, thus applying a centrifugal force to the damping elements in the radial direction of the rotor;

bringing the damping elements into contact with one another at at least one contact surface due to the centrifugal force applied to the damping elements;

bringing the first damping element of said at least one set of damping elements into contact with a first friction surface of a first adjacent blade due to the centrifugal force applied to the first damping element; and bringing the second damping element of said at least one set of damping elements into contact with a second friction surface of a second adjacent blade due to the centrifugal force applied to the second damping element.

16. The method as claimed in claim 15, wherein at least two sets of damping elements are arranged in one of an identical configuration and a different configuration over the axial extent of the blades.

17. The method as claimed in claim 15, wherein at least one set of damping elements are arranged in one of an identical configuration and a different configuration between further adjacent blades.

* * * * *